United States Patent [19]

O'Neill et al.

[11] Patent Number: 5,011,229

[45] Date of Patent: Apr. 30, 1991

[54] MINER CUTTING BIT HOLDING APPARATUS

[75] Inventors: Michael L. O'Neill, Lucinda; Stephen P. Moore, Sandy Lake; Eugene F. Pendolino, Franklin, all of Pa.

[73] Assignee: Joy Technologies Inc., Pittsburgh, Pa.

[21] Appl. No.: 475,063

[22] Filed: Feb. 5, 1990

Related U.S. Application Data

[63] Continuation-in-part of Ser. No. 269,381, Nov. 9, 1988, Pat. No. 4,915,455.

[51] Int. Cl.[5] ..... E21C 35/18

[52] U.S. Cl. ..... 299/91; 299/93

[58] Field of Search ..... 299/79, 86, 91, 93; 37/141 T, 142 R; 407/46, 47, 101, 102, 120

[56] References Cited

U.S. PATENT DOCUMENTS

| | | | |
|---|---|---|---|
| 3,749,449 | 7/1973 | Krekeler | 299/93 |
| 3,841,708 | 10/1974 | Kniff et al. | 299/86 |
| 3,992,061 | 11/1976 | Rollins | 299/93 |
| 4,163,581 | 8/1979 | Krekeler | 299/91 |
| 4,240,669 | 12/1980 | Rollins | 299/91 |
| 4,275,929 | 6/1981 | Krekeler | 299/91 |
| 4,343,516 | 8/1982 | Aden | 299/91 |
| 4,542,943 | 9/1985 | Montgomery, Jr. | 299/93 |
| 4,621,870 | 11/1986 | Levefelt | 299/91 |
| 4,650,254 | 3/1987 | Wechner | 299/91 |
| 4,828,327 | 5/1989 | Wecher | 299/91 |

FOREIGN PATENT DOCUMENTS

| | | | |
|---|---|---|---|
| 1266137 | 3/1972 | United Kingdom | 299/93 |
| 2074631 | 11/1981 | United Kingdom | 299/93 |

*Primary Examiner*—Bruce M. Kisliuk

*Attorney, Agent, or Firm*—Kirkpatrick & Lockhart

[57] ABSTRACT

Apparatus for supporting a cutting bit having an extended shank on a rotatable cutting drum is provided. The support apparatus includes a bit holder having an upper body portion and a shank portion and a generally rectangular mounting base having rear, side and front members. The upper body of the bit holder includes a bore for receiving the cutting bit shank and upper rear abutment surfaces perpendicular to the bit axis. The shank of the bit holder has a lower rear abutment surface having horizontal and vertical areas and a threaded bore which extends into the shank intermediate the upper and lower abutment surfaces. The rear portion of the mounting base includes upper abutment surfaces perpendicular to the bit axis and a lower abutment surface having horizontal and vertical areas. A draw bolt passes through the rear portion of the mounting base and serves to draw the upper and lower abutment surfaces of the bit holder and mounting base, respectively, into engagement.

23 Claims, 6 Drawing Sheets

MINER CUTTING BIT HOLDING APPARATUS

This is a continuation-in-part of copending application(s) U.S. Ser. No. 07/269,381, filed on Nov. 9, 1988 U.S. Pat. No. 415455.

BACKGROUND OF THE INVENTION

1. Field of the Invention

The present invention relates to miner cutting bit holders and, in particular, to miner bit holders which include a mounting base attached to a rotating cutting drum and a replaceable cutting bit holder.

2. Description of the Invention Background

In the materials mining industry it is typical to employ a mining apparatus which includes a vertically moveable rotating cutting drum which has cutting bits attached thereto. By virtue of the rotation of the cutting drum and the movement of the miner into the material to be mined, the material is removed for further processing.

It is well known that such cutting bits and their holders are subjected to considerable stresses during the mining operation. Such stresses occur axially, vertically and transverse relative to the cutting bit. Accordingly, in normal mining operations, cutting bits require frequent replacement due to wear or breakage. In fact, cutter bits must often be replaced on a daily basis. In view of this phenomenon, much effort has heretofore been directed to the provision of readily replaceable cutter bits which may be removed with a minimum of effort from their supports.

Because the bit holding devices are not the primary vehicles by which material is removed from the mine face, the bit holding devices are generally characterized by a longer service life. As such, the prior art has developed bit holding systems which include a bit holder which physically retains the cutting bit and which may be mounted in a mounting base which may be directly or indirectly welded into the miner's cutting drum. Nevertheless, the bit holders themselves are subject to considerable wear and breakage and may require replacement on two to six month intervals.

It is also known that bit holders must be able to hold the cutting bits against axial movement while allowing the cutting bits to freely rotate in order to minimize wear in any single localized region. However, the cutting bit holder must be securely fastened to the mounting base because, if not, looseness will occur between the bit holder and the mounting base which will quickly accelerate into deterioration of either or both of those components.

While the prior art has endeavored to provide miner bit holders which include bit holders and separate mounting bases, Applicants have discovered that the prior art bit holding devices do not sufficiently restrain lateral, axial and vertical movement between a bit holder and a mounting base to eliminate movement therebetween and, thus, the associated problems resulting therefrom. As such, due to their design, prior art bit holder-mounting base combinations are prone to premature failure.

Accordingly, the need exists for a miner cutting bit holding apparatus which includes a bit holder which may appropriately restrain the cutting bit while being replaceably received within a mounting base attached to the cutting drum to eliminate relative movement therebetween and which, consequently, avoids failure of the bit holder and mounting base to eliminate the awaiting frequent replacement of one or both of those elements.

SUMMARY OF THE INVENTION

In general, the present invention relates to apparatus for attaching a cutting bit to the roratable drum of a mining machine. Such cutting bits typically comprise an elongated cylindrical or rectangular shank portion to which there is attached a conical nose which has a hard cutting tip secured thereto. The opposite end of the shank portion includes an annular notch and may terminate in an end shoulder.

The instant invention includes a removable bit holder which supports the cutting bit and a mounting base which receives the bit holder and which may be directly affixed to the cutting drum or affixed to a riser block which, in turn, is affixed to the cutting drum.

The bit holder includes an upper body portion which is provided with an aperture therethrough to receive the cutting bit. A shoulder between the shank and conical nose portions of the cutting bit bears against the upper forward portion of the bit holder. A retaining ring is provided about the annular notch on the cutting bit so as to coact with the rear surface of the bit holder to prevent axial removal of the cutting bit.

The upper portion of the bit holder also includes upper, generally rearwardly and downwardly facing lateral abutment members extending from the rear surface thereof and which are generally perpendicular to the axis of the cutting bit. In addition, the bit holder includes a shank portion having a lower rear, generally rearwardly and upwardly facing abutment surface. The lower abutment surface is generally parallel to the cutting bit axis. A longitudinal threaded bore is also provided in the bit holder shank between the upper and lower abutment surfaces to receive a draw bolt for the purposes hereinafter described.

The mounting base includes a generally rectangular body member having a cavity formed therein for receiving the shank of the bit holder and for preventing lateral movement between the shank and the mounting base. The forward end of the mounting base includes a crossmember of reduced elevation to facilitate bit holder insertion. The mounting base is also provided with a rear member having two laterally spaced, generally forwardly and upwardly facing abutment surfaces which are borne against by the upper abutment surfaces of the bit holder. A recess is provided between the upper abutment surfaces of the mounting base so as to allow installation and removal of the cutting bit retaining ring. The rear portion of the mounting base also includes a lower, generally forwardly and downwardly facing abutment surface which is borne against by the lower abutment surface of the bit holder. A bore is provided in the rear member of the mounting base in order that the draw bolt may pass therethrough and into the threaded bore in the bit holder shank. As such, the draw bolt acts between the corresponding upper and lower abutment surfaces and its tightening urges the upper and lower abutment surfaces of the bit holder and mounting base into secure contact thereby preventing movement therebetween.

We have also discovered that although the miner cutting bit holding apparatus of the present invention represents a considerable advancement in the art in many respects, in certain applications its performance may be improved. In the abovedescribed embodiment of the invention, the bit holders could become unseated in certain mining conditions and the bit holder would slide upward and rearward along the upper sloped surfaces. This could result in the bending of the bolt upward or possibly, in extreme cases, the breaking of the bolt and the detachment of the bit holder. We believe that this phenomenon may be caused because the sliding action of the bit holder has a vertical component along both the upper sloped surfaces and the lower surfaces thereby allowing a combined upward movement component which is sufficient to allow the bending of the bolt.

In a preferred embodiment of the invention, the lower abutment surface of the bit holder is modified to include a vertical area and a horizontal area. Similarly, the lower abutment surface of the mounting base includes a corresponding vertical area and a horizontal area. We have found that the provision of substantially horizontal lower surfaces eliminates all upward motion of the bit holder. The vertical surfaces are also careful in accurately positioning the bit holder and to avoid the high localized stresses which would result if the bit holder was able to slide rearward along the lower horizontal surfaces under bolt tension.

Accordingly, the present invention provides solutions to the aforementioned problems with miner bit holding apparatuses. As this invention provides a cutting bit holder and mounting base having cooperating abutment surfaces on opposite sides of the tightening means which act perpendicular and parallel to the cutting bit axis, the bit holder and mounting base are securely joined by a wedging action.

These and other details, objects and advantages of the present invention will become apparent as the following description of the preferred embodiment thereof proceeds.

BRIEF DESCRIPTION OF THE DRAWINGS

In the accompanying drawings, we have shown a present preferred embodiment of the invention wherein.

DETAILED DESCRIPTION OF THE PREFERRED EMBODIMENTS

Figure 1:
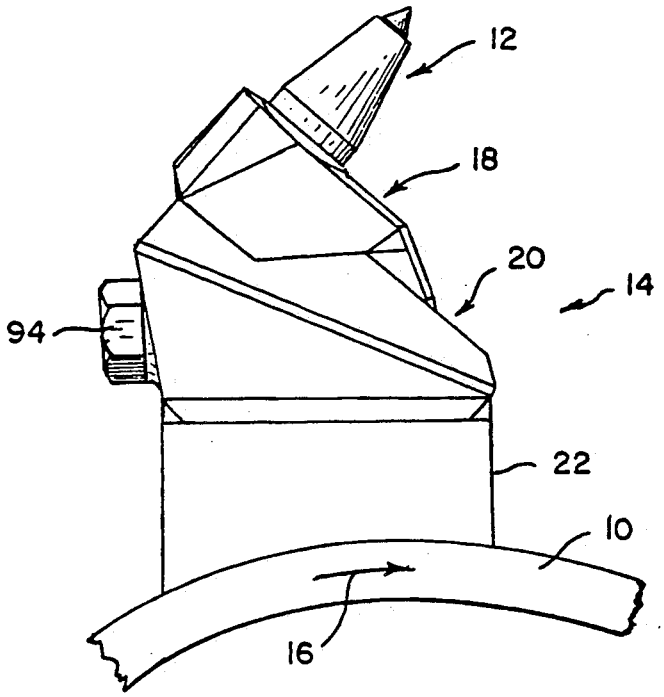
FIG. 1 is a side elevation view of the cutting bit holding apparatus according to the present invention.

Referring now to the drawings wherein the showings are for purposes of illustrating the present preferred embodiments of the invention only and not for purposes of limiting same, the Figures show a mining machine cutting drum 10 which supports a cutting bit 12 by means of a bit holding apparatus 14.

More particularly and with reference to FIG. 1, there is depicted the cutting drum 10 of a mining machine which is supported thereby for rotation in the direction shown by the arrow 16. As is well known in the art, the cutting drum 10 is supported by the mining machine for rotation while being elevatable and while the mining machine advances from left to right as shown in FIG. 1. As is also well known, the cutting drum 10 typically includes a plurality of cutting bits 12 arranged thereon; however, the present description will now be directed to a single cutting bit 12 and the structure of a single present bit holding apparatus 14.

As used herein, "up" will refer to the direction away from the cutting drum 10 while "down" will refer to a direction toward the cutting drum 10. Further, "forward" will refer to the direction tangent to the cutting direction in the cutting direction and "rearward" will refer to the direction tangent to the cutting direction in a direction opposite to the cutting direction. Also, as used hereinafter and in the claims, "vertical" will refer to the direction perpendicular to the tangent to the cutting drum at the point of attachment of the bit holding apparatus 14 and "horizontal" will refer to the direction parallel to the tangent to the cutting drum at the point of attachment of the bit holding apparatus 14.

Generally speaking, bit holding apparatus 14, as shown in FIG. 1, includes a bit holder 18 and a mounting base 20. As described hereinafter, the bit holder 18 receives and retains the cutting bit 12 and is removably secured to mounting base 20. Mounting base 20 may be directly affixed to cutting drum 10 as by welding or may be affixed to a riser block 22 having a radiused lower surface and which serves to present all cutting bits 12 at a common elevation and which may also be attached to cutting drum 10 as by welding.

Figure 3:
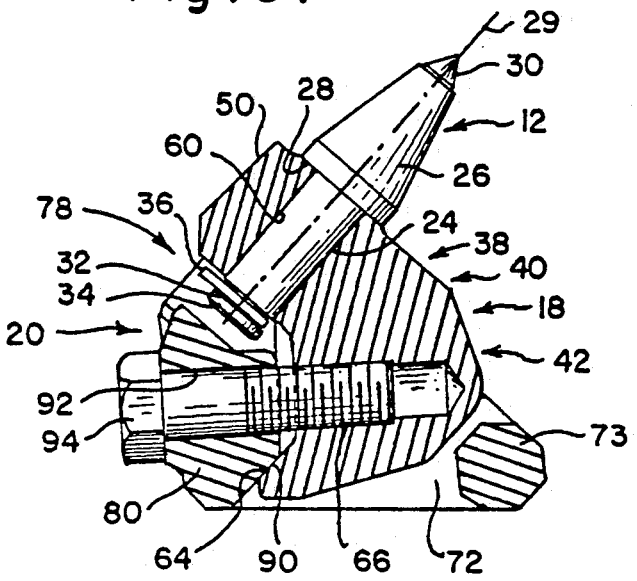
FIG. 3 is a side section view of the bit holding assembly generally taken along the lines 3—3 of FIG. 2, but showing the cutting bit and draw bolt in full.

The cutting bit 12 may be of a previously established design including a central cylindrical shank portion 24, shown in FIG. 3, having an enlarged conical nose 26 attached thereto such that a shoulder area 28 is formed therebetween. However, the shank 24 may, alternatively, be noncircular in cross-section. In any event, the cutting bit, thus, has a central axis shown at 29. A hard cutting tip 30 is provided on one end of the cutting bit 12 of a material and in a manner known in the art. The cutting bit 12 includes on its other end a recessed notch 32 and terminates in an end shoulder 34 such that a retaining ring 36 may be received within the notch 32.

Research has shown that the preferred angle A, shown in FIG. 1, between the tangent B to the circle C traversed by tip 30 and the axis 29 of the cutting bit 12 is preferably 50 °. While the mounting base 20 and bit holder 18 may coact to support the cutting bit 12 at such an angle, Applicants have discovered that it is preferable to construct the mounting base 20 and the bit holder 18 to hold the cutting bit 12 at a 45° angle and to have the remaining 5° provided by forming the riser block 22 so that the rear of its upper surface, is elevated by 5°.

Figure 4:
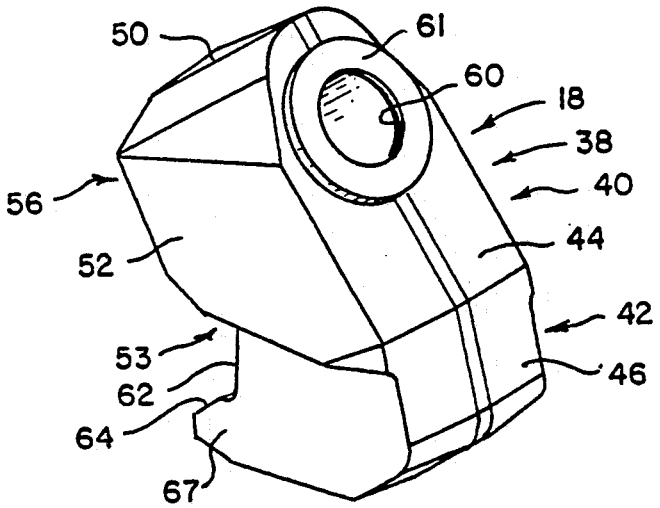
FIG. 4 is a perspective view of the bit holder disclosed herein.
Figure 5:
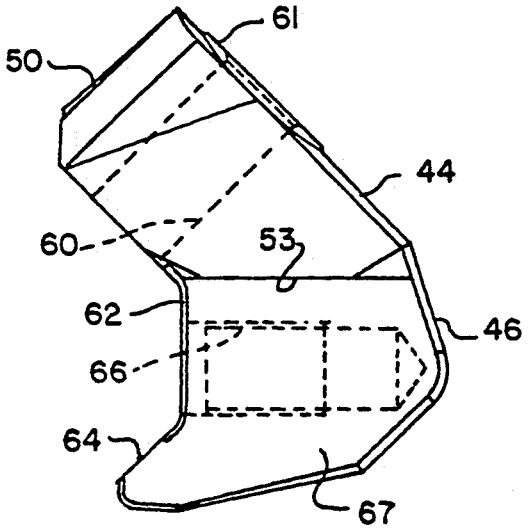
FIG. 5 is a side elevation view of the bit holder according to this invention.
Figure 6:
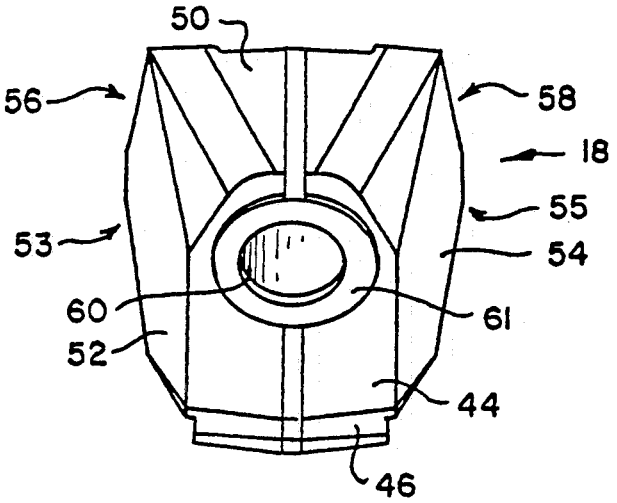
FIG. 6 is a top plan view of the bit holder.
Figure 7:
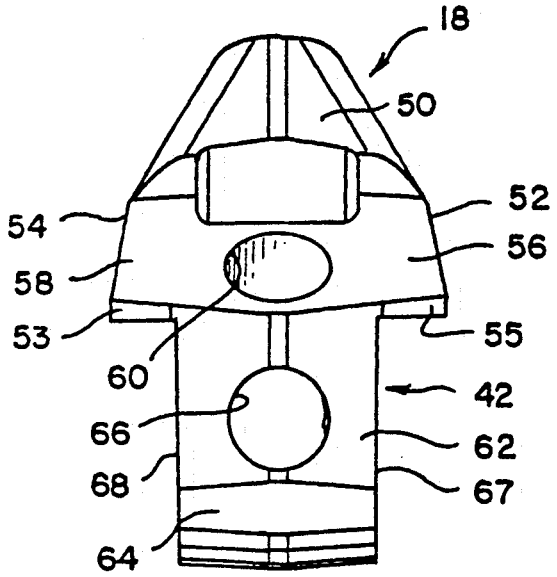
FIG. 7 is a rear elevation view of the bit holder.

As shown in FIG. 4, the bit holder 18 has a body member 38 which includes an upper portion 40 and an extended shank portion 42. The upper portion 40 includes at its forward end an upper forward surface 44 which is continued downward into an upper leading surface 46. The upper body portion 40 of the bit holder 18 also includes an upper rear surface 50. The upper body portion 40 also includes left and right laterally extending members 52 and 54, respectively. As shown in FIG. 7, left and right lateral members 52 and 54, respectively, are provided with lower left and right substantially horizontal abutment surfaces 53 and 55, respectively, and with left and right rearwardly and downwardly facing abutment surfaces 56 and 58, respectively. Abutment surfaces 56 and 58 are preferably disposed at an angle which is substantially perpendicular to the axis of the cutting bit 12. As used herein, "substantially" refers to angles which are within 15° of the designated orientation. As shown in FIG. 4, extending throughout upper body portion 40 between upper forward surface 44 and upper rear surface 50 is an aperture 60 which corresponds to the cross-section of shank 24. When the shank 24 is cylindrical, the aperture 60 is of dimensions which are slightly larger than that of the shank portion 24 of the cutting bit 12. In that case, the bore 60 is configured so as to retain the cutting bit 12 therein while allowing it to rotate in order to avoid wearing of only one portion of the pip 30 of the cutting bit. A bearing surface 61 is provided on the front outer surface of bit holder 18 about the bore 60 to receive the bit holder shoulder 28.

Figure 2:
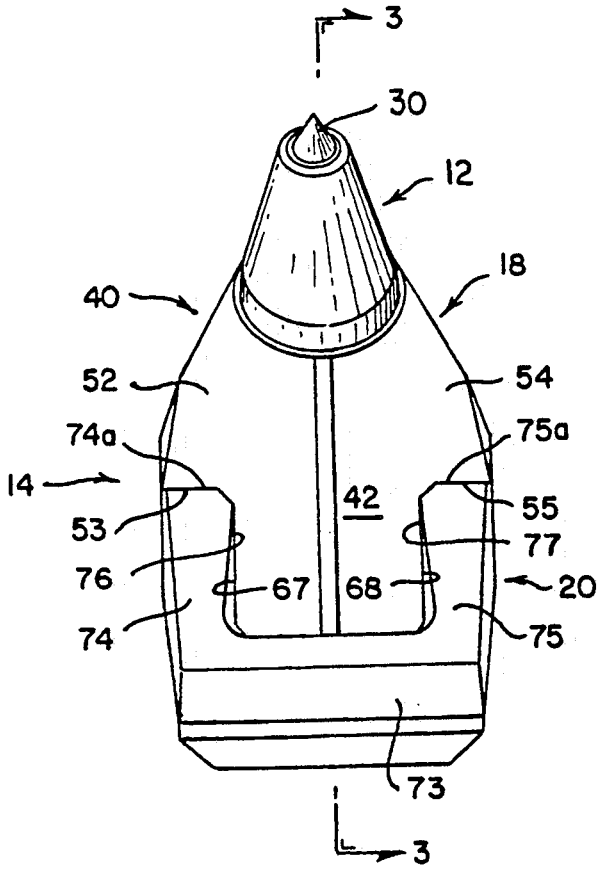
FIG. 2 is a front elevation view of the cutting bit holder assembly according to the present invention.

The shank 42, as shown in FIG. 7 of the bit holder 18 is provided with a rear substantially vertical surface 62 and a rear generally rearwardly and upwardly extending abutment surface 64, shown in FIG. 4. Rear abutment surface 64 is preferably disposed substantially parallel to the axis of the cutting bit 12 and, thus, is substantially perpendicular to left and right abutment surfaces 56 and 58, respectively. Extending into shank 42 from rear surface 62 is a threaded bore 66, shown in FIG. 7. The shank 42 also includes on its lower lateral sides a left vertical abutment surface 67 and a parallel right abutment surface 68, shown in FIG. 2.

Figure 8:
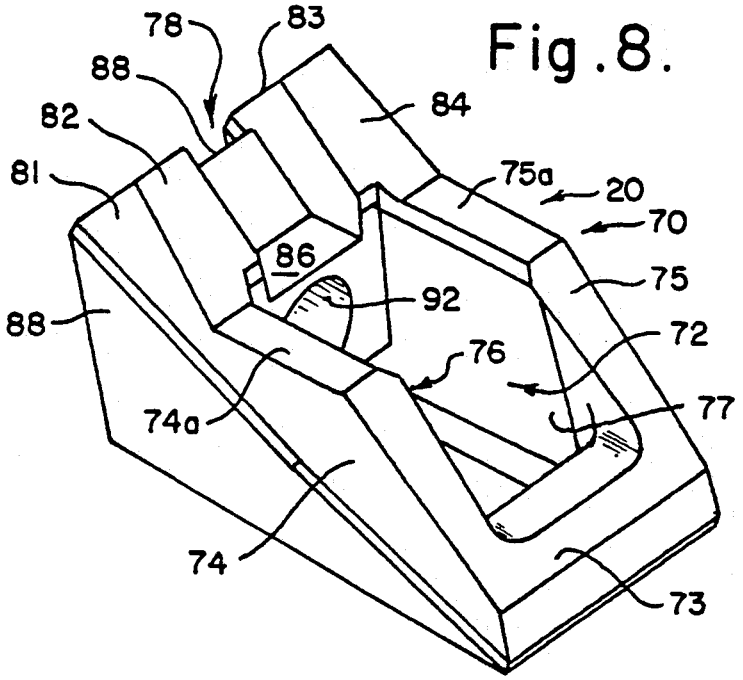
FIG. 8 is a perspective view of the mounting base according to the present invention.
Figure 9:
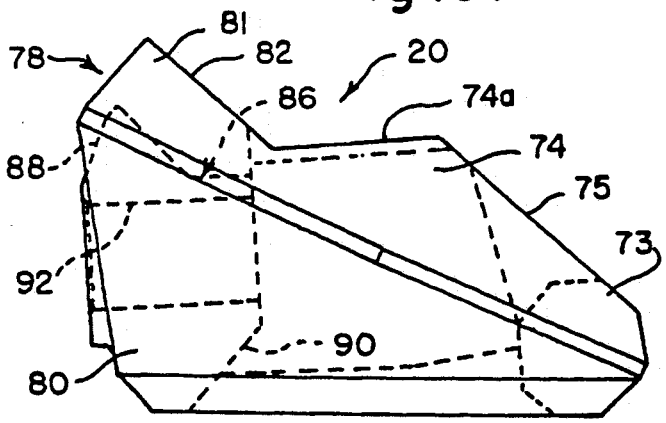
FIG. 9 is a side elevation view of the mounting base according to the present invention.
Figure 10:
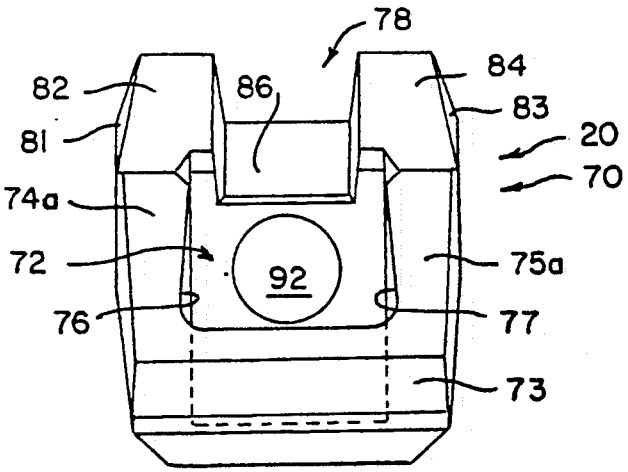
FIG. 10 is a front elevation view of the mounting base according to the present invention.
Figure 11:
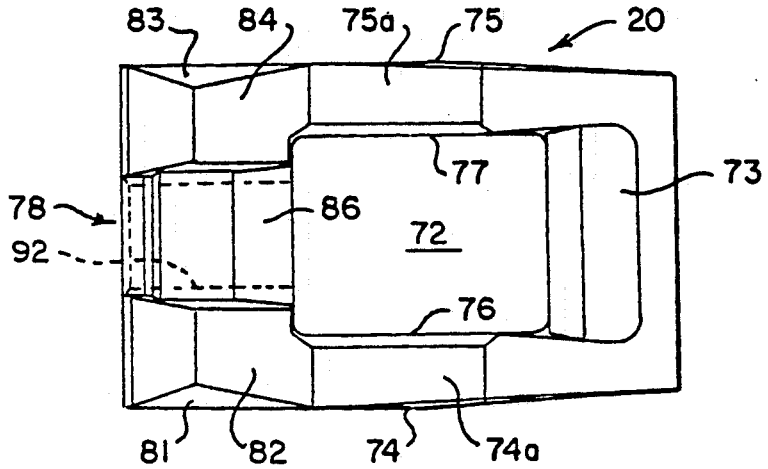
FIG. 11 is a top plan view of the mounting base according to this invention.

As shown in FIG. 11 in plan view, the mounting base 20 comprises a generally rectangular body member 70 having a central cavity 72 disposed therein. The mounting base body member 70 includes a front crossmember 73 extending between left and right elevated side members 74 and 75, respectively. Left side member 74 is provided with an upper left substantially horizontal abutment surface **74*a* and an inner vertical abutment surface 76 while right side member 75 is provided with an upper right substantially horizontal abutment surface 75*a* and an inner vertical abutment surface 77. As shown in FIG. 9, the mounting base body member 70 also includes a rear member 80 which extends upwardly beyond the height of left and right side members 74 and 75, respectively. As seen in FIG. 11, cavity 72 is defined by front crossmember 73, left and right abutment surfaces 76 and 77, respectively, and rear member 80, as shown in FIG. 9. The upper portion of rear body member 80 includes a yoke member 78 having a left upper member 81 having a left abutment surface 82 and a right upper member 83 having a right abutment surface 84. As shown in FIG. 8, the abutment surfaces 82 and 84 are generally forwardly and upwardly facing so as to be perpendicular to the axis 29 of cutting bit 12 and, thus, are parallel to and, respectively, engaged by the left abutment surface 56 and the right abutment surface 58 of the bit holder 18. Intermediate the left and right upper members 81 and 83, respectively, is a recessed area 86 which is bounded at its rear by a raised member 88. Recessed area 86 is provided to allow removal of the retaining ring 36 and the insertion of a tool to force the bit shank 24 from bore 60. As shown in FIG. 3, the lower inner portion of rear member 80 is provided with a lower generally forwardly and downwardly facing abutment surface 90 which is parallel to and intended to be engaged by the rear abutment surface 64 of the bit holder 18 when the shank 42 is inserted into cavity 72 in the mounting base 20. As such, the lower abutment 90 surface and the rear abutment surface 64 are disposed vertically beneath the axis 29 of the cutting bit 12. A cylindrical bore 92, as shown in FIG. 3, is provided through the rear member 80 of the mounting base 20 in coaxial alignment with the bore 66 in the bit holder 18 when disposed in the cavity 72. As such, a draw bolt 94 may be inserted through bore 92 and threaded into bore 66 in the bit holder to draw the bit holder 18 into engagement with the mounting base 20**.

In the operation of the bit holding apparatus 14, as shown in FIG. 3, the cutting bit 12 is inserted into the bore 60 in the bit holder 18 and the retaining ring 36 is affixed to the annular notch 32. By virtue of the end shoulder 34 engaging the retaining ring 36 which is adjacent the rear upper surface of bit holder 18, the cutting bit 12 may not be removed from the bore 60. The shank 42 of bit holder 18 is then placed within cavity 72. Because a close fit is provided between the shank's left and right abutment surfaces 67 and 68, respectively, and the left and right abutment surfaces 76 and 77 of the mounting base 20, the shank may not be laterally displaced or pivoted within cavity 72. The bolt 94 is passed through the bore 92 in mounting base 20 and into the threaded bore 66 in the bit holder shank 42. When the bolt 94 is tightened against the rear surface of rear member 80 or other similar force generating means are employed, the rear surfaces of bit holder 18 will be urged toward the front surfaces of the rear member 80 of the mounting base 20. When this occurs, the left upper abutment surface 56 of the bit holder 18 will be drawn into tight engagement with left abutment surface 82 of the mounting base 20, the right upper abutment surface 58 of the bit holder 18 will be drawn into engagement with the right abutment surface 84 of the mounting base 20 and the lower abutment surface 64 of the bit holder 18 will be drawn into engagement with the rear abutment surface 90 of the mounting base 20. Because the forces generated by tightening the draw bolt 94 are provided intermediate the upper abutment surfaces and the lower abutment surfaces of the bit holder 18 and the mounting base 20, a symmetrical wedging action serves to join those members and prevent relative movement therebetween. In addition, the tightening of the draw bolt 94 preferably urges the lower left horizontal abutment surface 53 of the bit holder 18 into engagement with the upper left abutment surface **74*a* of the mounting base 20 and the lower right abutment surface 55 into engagement with the upper right abutment surface 75*a***.

Figure 12:
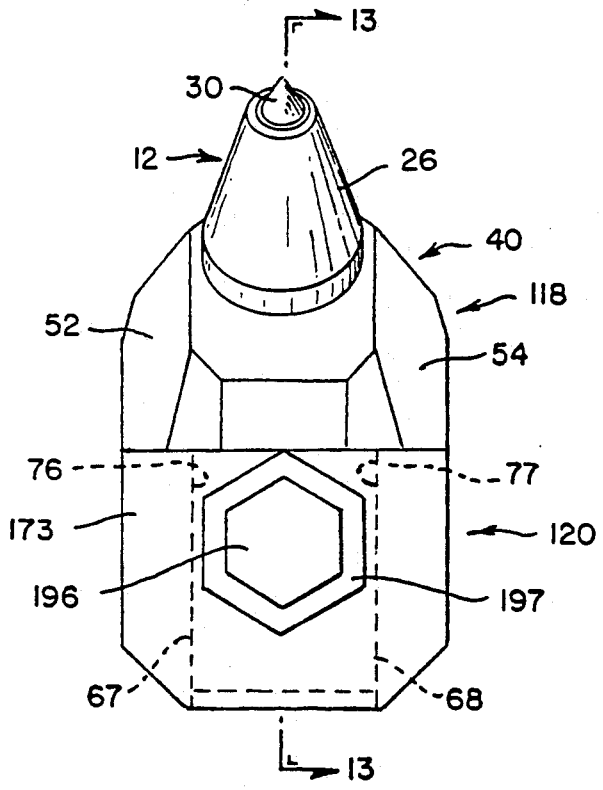
FIG. 12 is a front elevation view of an alternative embodiment of the invention.
Figure 13:
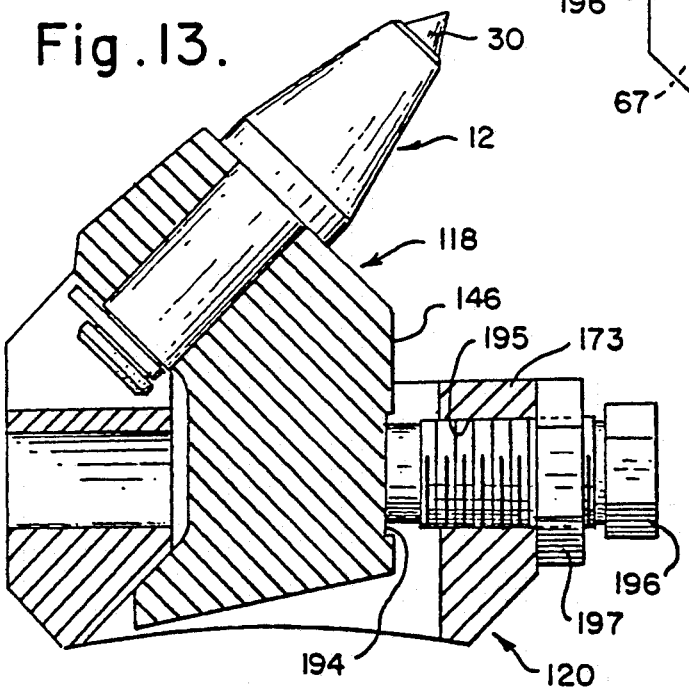
FIG. 13 is a side section view of the alternative embodiment of the invention shown in FIG. 12 and taken along the lines 13—13 of FIG. 12, but showing the cutting bit and setscrew in full.

In an alternative embodiment of the present invention shown in FIGS. 12 and 13, wherein like reference numerals refer to similar elements in the embodiment previously described, the mounting base is indicated as 120.

The bit holder is shown as 118 and the bit holder 118 is similar to bit holder 18 except that the upper leading surface 146 is substantially vertical and has a recessed vertical bearing surface 194. Also, the front crossmember 173 is of a greater height than crossmember 73 and includes a bore 195 therethrough. A setscrew 196 is provided which may pass through bore 195 to generate a rearward force against bearing surface 194 when the setscrew 196 is tightened against the forward surface of crossmember 173. As will be understood by those skilled in the art, by analogy to FIGS. 7, such force serves to urge the first abutment surfaces 56 and 58 of the bit holder 118 against upper abutment surfaces 82 and 84, respectively, and to urge second abutment surface 64 against lower abutment surface 90. A lock nut 197, shown in FIG. 12, is provided to restrain setscrew 196 against rotation. It is additionally recognized that, in the event either of the mounting bases 20 or 120 are to be directly mounted on drum 10, the lower surface of the mounting base may be radiused to comport with the radius of drum 10 in order that it may be welded thereto.

Figure 14:
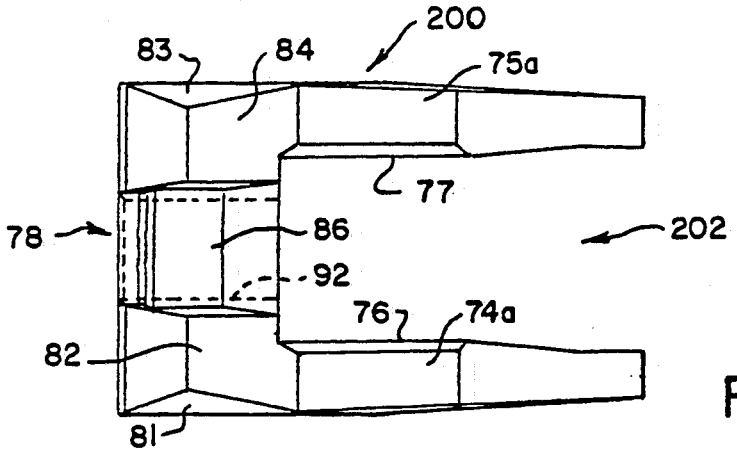
FIG. 14 is a top view of another alternative embodiment of the invention.

Another alternative embodiment of the present invention is shown in FIG. 14, wherein like reference numerals refer to similar elements in the embodiment first above discussed, the mounting base is indicated as 220. In this embodiment, the front crossmember is not present such that the cavity 72 formed in the embodiments discussed above is instead formed as a slot 202 which may accept the shank 42 of the bit holder 18. In this embodiment, the shank 42 may be more readily inserted into the slot 202 than in a cavity such as 72.

Figure 15:
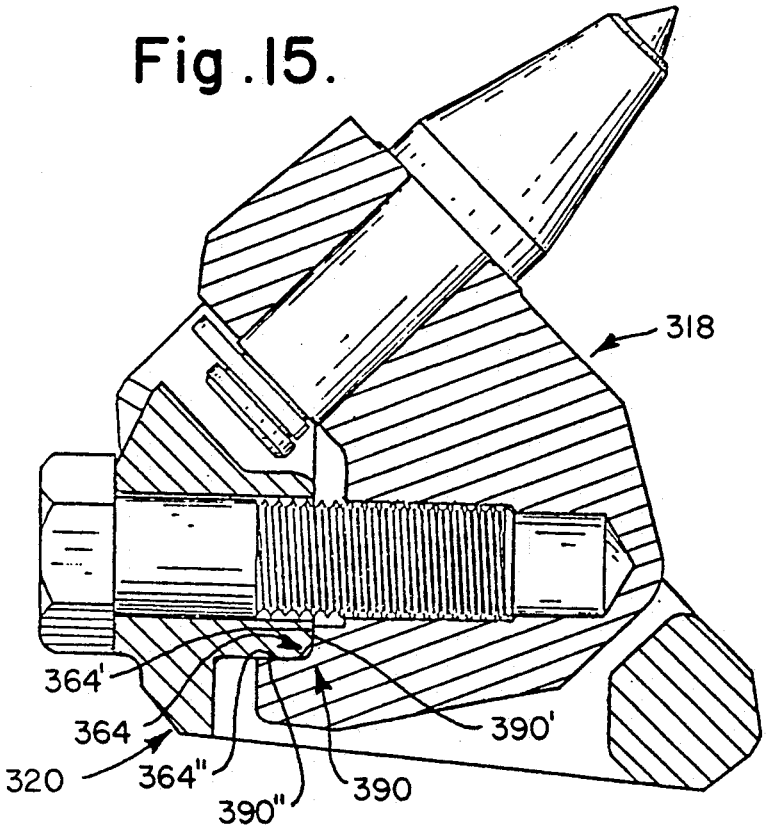
FIG. 15 is a side section view of yet another alternative embodiment of the invention.

Yet another alternative embodiment of the invention is shown in FIG. 15, wherein like reference numerals refer to similar elements in the embodiment first above discussed. In this embodiment, the mounting base is identified as 320 and is similar to mounting base 20 except as regards lower abutment surface 90. Also, the bit holder is shown as 318 and is similar to bit holder 18, except with respect to the rear abutment 64. According to this embodiment, the lower abutment surface 390 includes a vertical area 390', which is preferably substantially perpendicular to the primary direction of force of the bolt or urging means 94, adjacent to a horizontal area 390", which is preferably substantially parallel to the primary direction of force of the bolt or urging means 94. Also, the rear abutment surface 364 includes a vertical area 364', which is preferably substantially perpendicular to the primary direction of force of the bolt or urging means 94, adjacent to a horizontal area 364", which is substantially parallel to the primary direction of force of the bolt or urging means 94.

In the operation of this embodiment of the invention, when the bolt 94 is tightened against the rear surface of rear member 80 or other similar force generating means are employed, the rear surfaces of the bit holder 318 are urged toward the front surfaces of the rear member 80 of the mounting base 320. When this occurs, now with reference by analogy to FIGS. 7, 8 and 9, the left and right upper abutment surfaces 56 and 58, respectively, of the bit holder 318 will be drawn into engagement with the left and right abutment surfaces 82 and 84, respectively, of the mounting base 320. In addition, as shown in FIG. 15, the horizontal area 364" of the rear abutment surface 364 of the bit holder 318 is drawn into engagement with the horizontal area 390" of the lower abutment surface 390 of the mounting base 320. Also, we prefer that the tightening of bolt 94 serves to bring the vertical area 364' of the rear abutment surface 364 into engagement with the vertical area 390' of the lower abutment surface 390. As such, the upward motion of the bit holder 318 is eliminated. Further, the vertical areas 364' and 390' are not required, but are preferred, inter alia, to positively position the bit holder 318 and avoid the high stresses which would result if the bit holder 318 were able to slide rearward along the horizontal areas 364" and 390" under bolt 94 tension. It will also be appreciated that the modifications disclosed relative to FIG. 15 will also find applicability with respect to the embodiments of FIGS. 12–14.

It will be understood that various changes in the details, materials and arrangements of parts which have been herein described and illustrated in order to explain the nature of the invention, may be made by those skilled in the art within the principle and scope of the invention expressed in the appended claims.

What is claimed is:

1. Apparatus for supporting a cutting bit on a moveable cutting head at a predetermined cutting angle, said cutting bit having an extended shank and a central axis passing through said shank, comprising:

a. a bit holder having an upper body portion and a lower shank portion where said body portion includes an aperture for receiving said shank of said cutting bit for supporting said cutting bit at said predetermined cutting angle, and at least one rear upper first abutment surface disposed substantially perpendicular to the axis of said cutting bit, and said shank portion includes a rear lower second abutment surface having a substantially horizontal primary area;

b. a mounting base which may be attached to said cutting head, said mounting base having a cavity therein for receiving the shank portion of said bit holder, said mounting base having a rear member having at least one forward upper abutment surface disposed substantially perpendicular to the axis of said cutting bit and engaged by said at least one first abutment surface and a forward lower abutment surface having a substantially horizontal secondary area which is engaged by the horizontal primary area of said second abutment surface; and c. means for urging said at least one first abutment surface into engagement with said at least one forward upper abutment surface of said mounting base and said horizontal primary area of said second abutment surface into engagement with said horizontal secondary area of said forward lower abutment surface of said mounting base.

2. Apparatus of claim 1 in which:

a. said rear lower second abutment surface comprises a substantially vertical primary area adjacent to said substantially horizontal primary area of said bit holder;

b. said forward lower abutment surface comprises a substantially vertical secondary area adjacent to said substantially horizontal secondary area of said mounting base; and c. said means for urging also urges said substantially vertical primary area into engagement with said substantially vertical secondary area.

3. Apparatus of claim 1 in which said shank portion of said bit holder further comprises lateral vertical abutment surfaces and said mounting base further comprises lateral vertical abutment surfaces substantially defining the lateral sides of said cavity such that said lateral vertical surfaces of said bit holder coact with said lateral vertical surfaces of said mounting base to prevent lateral displacement of said bit holder within said mounting base.

4. Apparatus of claim 1 in which said means for urging comprises:

a. a first generally rearwardly extending threaded bore provided in said shank portion of said bit holder;

b. a second bore extending through said rear member of said mounting base which is coaxial with said first bore; and c. a draw bolt which may be inserted through said second bore and into said threaded first bore to bear against the rear surface of said rear member to draw said first and said upper abutment surfaces into engagement and said second and said lower abutment surfaces into engagement.

5. Apparatus of claim 4 in which said first bore is vertically disposed between said first and said second abutment surfaces.

6. Apparatus of claim 1 in which said mounting base further comprises a forward member which is of a height less than said rear member to facilitate insertion of said shank portion of said bit holder into said cavity.

7. Apparatus of claim 1 in which said cavity comprises a forward-opening slot for receiving said shank portion of said bit holder.

8. Apparatus of claim 1 in which said mounting base further comprises a forward member and said means for urging comprises:

a. a first generally forwardly extending threaded bore provided in said forward member of said mounting base;

b. a generally vertical bearing surface provided on the forward side of said bit holder and normal to said first bore; and c. a setscrew which may be threaded into said threaded first bore to bear against said bearing surface to force said at least one first and said at least one upper abutment surfaces into engagement and said second and said lower abutment surfaces into engagement.

9. Apparatus of claim 8 in which said first bore is vertically disposed between said at least one first and second abutment surfaces.

10. Apparatus for supporting a cutting bit on a moveable cutting head at a predetermined cutting angle, said cutting bit having an extended shank and a central axis passing through said shank, comprising:

a. a bit holder having an upper body portion and a lower shank portion where said body portion includes an aperture for receiving said shank of said cutting bit for supporting said cutting bit at said predetermined cutting angle and rear upper lateral extended members each having a first abutment surface, said first abutment surfaces being coplanar and disposed substantially perpendicular to and on opposite lateral sides of the axis of said cutting bit, and said shank portion includes a rear lower second abutment surface having a substantially horizontal primary area;

b. a mounting base which may be attached to said cutting head, said mounting base having a cavity therein for receiving the shank portion of said bit holder, said mounting base having a rear member having an upstanding yoke having upper forward abutment surfaces which are substantially perpendicular to and on opposite lateral sides of said axis of said cutting bit and which are engaged by the corresponding said first abutment surfaces and a lower forward abutment surface having a substantially horizontal secondary area which is engaged by the horizontal primary area of said second abutment surface; and c. means for urging said first abutment surfaces of said bit holder into engagement with said upper abutment surfaces of said mounting base and said horizontal primary area of said second abutment surface of said bit holder into engagement with said horizontal secondary area of said lower abutment surface of said mounting base.

11. Apparatus of claim 10 in which:

a. said rear lower second abutment surface comprises a substantially vertical primary area adjacent to said substantially horizontal primary area of said bit holder;

b. said forward lower abutment surface comprises a substantially vertical secondary area adjacent to said substantially horizontal secondary area of said mounting base; and c. said means for urging also urges said substantially vertical primary area into engagement with said substantially vertical secondary area.

12. Apparatus of claim 10 in which said shank of said bit holder further comprises lateral vertical abutment surfaces and said mounting base further comprises lateral vertical abutment surfaces substantially defining the lateral sides of said cavity such that said lateral vertical surfaces of said bit holder coact with said lateral vertical surfaces of said mounting base to prevent lateral displacement of said bit holder within said mounting base.

13. Apparatus of claim 10 in which said means for urging comprises:

a. a first generally rearwardly extending threaded bore provided in said shank portion of said bit holder;

b. a second bore extending through said rear member of said mounting base which is coaxial with said first bore; and c. a draw bolt which may be inserted through said second bore and into said threaded first bore to bear against the rear surface of said rear member to draw said first and said upper abutment surfaces into engagement and said second and said lower abutment surfaces into engagement.

14. Apparatus of claim 13 in which said first bore is vertically disposed between said first and said second abutment surfaces.

15. Apparatus of claim 10 in which said mounting base further comprises a forward member which is of a height less than said rear member to facilitate insertion of said shank portion of said bit holder into said cavity.

16. Apparatus of claim 10 in which said cavity comprises a forward-opening slot for receiving said shank portion of said bit holder.

17. Apparatus of claim 10 in which said mounting base further comprises a forward member and said means for urging comprises:

a. a first generally forwardly extending threaded bore provided in said forward member of said mounting base;

b. a generally vertical bearing surface provided on the forward side of said bit holder and normal to said first bore; and c. a setscrew which may be threaded into said threaded first bore to bear against said bearing surface to force said first and said upper abutment surfaces into engagement and said second and said lower abutment surfaces into engagement.

18. Apparatus of claim 17 in which said first bore is vertically disposed between said first and second abutment surfaces.

19. Apparatus for supporting a cutting bit on a moveable cutting head at a predetermined cutting angle, said cutting bit having an extended shank, an enlarged cutting head, a shoulder between said shank and said cutting head, and a central axis passing through said shank, comprising:

a. a bit holder having an upper body portion and a lower shank portion where said body portion includes an aperture for receiving said shank of said cutting bit for supporting said cutting bit at said predetermined cutting angle and a bearing surface adjacent said aperture which abuts said shoulder of said cutting bit, and rear upper lateral extended members each having a first abutment surface, said first abutment surfaces being coplanar and disposed substantially perpendicular to and on opposite lateral sides of the axis of said cutting bit, and said shank portion includes a rear lower second abutment surface having a substantially horizontal primary area;

b. a generally rectangular mounting base, in plan view, which may be attached to said cutting head, said mounting base having a cavity therein for receiving the shank portion of said bit holder, said mounting base having a rear member having an upstanding yoke having upper forward abutment surfaces which are substantially perpendicular to and on opposite lateral sides of said axis of said cutting bit and which are engaged by the corresponding said first abutment surfaces and a lower forward abutment surface having a substantially horizontal secondary area which is engaged by the horizontal primary area of said second abutment surface; and c. means for urging said first abutment surfaces of said bit holder into engagement with said upper abutment surfaces of said mounting base and said horizontal primary area of said second abutment surface of said bit holder into engagement with said horizontal secondary area of said lower abutment surface of said mounting base.

20. Apparatus of claim 19 in which:

a. said rear lower second abutment surface comprises a substantially vertical primary area adjacent to said substantially horizontal primary area of said bit holder;

b. said forward lower abutment surface comprises a substantially vertical secondary area adjacent to said substantially horizontal secondary area of said mounting base; and c. said means for urging also urges said substantially vertical primary area into engagement with said substantially vertical secondary area.

21. Apparatus of claim 19 in which said shank portion of said bit holder further comprises lateral vertical abutment surfaces and said mounting base further comprises lateral vertical abutment surfaces substantially defining the lateral sides of said cavity such that said lateral vertical surfaces of said bit holder coact with said lateral vertical surfaces of said mounting base to prevent lateral displacement of said bit holder within said mounting base.

22. Apparatus of claim 20 in which said means for urging comprises:

a. a first generally rearwardly extending threaded bore provided in said shank portion of said bit holder;

b. a second bore extending through said rear member of said mounting base which is coaxial with said first bore; and c. a draw bolt which may be inserted through said second bore and into said threaded first bore to bear against the rear surface of said rear member to draw said first and said upper abutment surfaces into engagement and said second and said lower abutment surfaces into engagement.

23. Apparatus of claim 22 which said first bore is vertically disposed between said first and said second abutment surfaces.

* * * * *

UNITED STATES PATENT AND TRADEMARK OFFICE

CERTIFICATE OF CORRECTION

PATENT NO. : 5,011,229

DATED : April 30, 1991

INVENTOR(S) : Michael L. O'Neill, Stephen P. Moore and Eugene F. Pendolino

It is certified that error appears in the above-identified patent and that said Letters Patent is hereby corrected as shown below:

Col. 1, line 6, delete "415455" and substitute --4,915,455-- therefor.

Col. 2, line 68, delete "abovedescribed" and substitute --above described-- therefor.

Col. 5, line 30, delete "pip" and substitute --tip-- therefor.

Col. 7, line 11, after "FIGS. 7," insert --8 and 9,-- therefor.

Col. 10, line 27, after "shank" Insert --portion--.

Signed and Sealed this

Tenth Day of November, 1992

*Attest:*

*Attesting Officer*

DOUGLAS B. COMER

*Acting Commissioner of Patents and Trademarks*